US010511088B2

(12) United States Patent
Xiao et al.

(10) Patent No.: US 10,511,088 B2
(45) Date of Patent: Dec. 17, 2019

(54) ANTENNA SYSTEM

(71) Applicant: Huawei Technologies Co., Ltd., Shenzhen (CN)

(72) Inventors: Weihong Xiao, Shenzhen (CN); Zhiqiang Liao, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/966,835

(22) Filed: Apr. 30, 2018

(65) Prior Publication Data

US 2018/0248256 A1 Aug. 30, 2018

Related U.S. Application Data

(63) Continuation of application No. PCT/CN2015/093455, filed on Oct. 30, 2015.

(51) Int. Cl.

| | |
|---|---|
| ***H01Q 21/00*** | (2006.01) |
| ***H01Q 9/16*** | (2006.01) |
| ***H01Q 1/48*** | (2006.01) |
| ***H01Q 3/44*** | (2006.01) |
| ***H01Q 1/40*** | (2006.01) |
| ***H01Q 9/06*** | (2006.01) |

(Continued)

(52) U.S. Cl.

CPC ..... *H01Q 1/48* (2013.01); *H01Q 1/246* (2013.01); *H01Q 1/405* (2013.01); *H01Q 3/44* (2013.01); *H01Q 9/06* (2013.01); *H01Q 9/16* (2013.01); *H01Q 19/108* (2013.01); *H01Q 19/17* (2013.01); *H01Q 21/0081* (2013.01); *H01Q 21/245* (2013.01); *H01Q 21/26* (2013.01);

(Continued)

(58) Field of Classification Search

CPC ..... H01Q 9/065; H01Q 9/16; H01Q 5/40; H01Q 5/48; H01Q 21/28; H01Q 21/30; H01Q 9/28; H01Q 21/24; H01Q 21/26; H01Q 25/001

USPC ..... 343/727, 793–823, 853

See application file for complete search history.

(56) References Cited

U.S. PATENT DOCUMENTS 4,218,685 A * 8/1980 Frosch ..... H01Q 1/28 343/727

7,053,852 B2 5/2006 Timofeev et al.

(Continued)

FOREIGN PATENT DOCUMENTS

CN 2758997 Y 2/2006

CN 1985404 A 6/2007

(Continued)

*Primary Examiner* — Binh B Tran

(74) *Attorney, Agent, or Firm* — Leydig, Voit & Mayer, Ltd.

(57) ABSTRACT

The present invention relates to the field of communications technologies and discloses an antenna system, and the antenna system includes: a radiating element, at least one strip line ground plane and signal cavity, and at least one inner conductor, where the radiating element includes radiation arms, radiation baluns, and feeding inner cores; the strip line ground plane is used as a reflective surface of the radiating element; the baluns of the radiating element are electrically connected to the strip line ground plane, and all of at least two feeding inner cores of the radiating element are electrically connected to one inner conductor. Therefore, a feeding manner of an existing array antenna can be optimized very conveniently, assembly time is greatly reduced, quantities of welding points and cables are reduced, and consistency and reliability are improved.

13 Claims, 5 Drawing Sheets

(51) Int. Cl.

| | |
|---|---|
| ***H01Q 19/17*** | (2006.01) |
| ***H01Q 21/24*** | (2006.01) |
| ***H01Q 1/24*** | (2006.01) |
| ***H01Q 19/10*** | (2006.01) |
| ***H01Q 21/26*** | (2006.01) |
| *H01Q 5/40* | (2015.01) |
| *H01Q 21/28* | (2006.01) |
| *H01Q 1/36* | (2006.01) |
| *H01Q 3/32* | (2006.01) |

(52) U.S. Cl.
CPC ..... *H01Q 1/36* (2013.01); *H01Q 3/32* (2013.01); *H01Q 5/40* (2015.01); *H01Q 9/065* (2013.01); *H01Q 21/24* (2013.01); *H01Q 21/28* (2013.01)

(56) References Cited

U.S. PATENT DOCUMENTS

| | | | | |
|---|---|---|---|---|
| 7,619,580 | B2 | 11/2009 | Lenart et al. | |
| 2009/0066602 | A1 | 3/2009 | Lindberg et al. | |
| 2010/0134374 | A1 | 6/2010 | Skalina et al. | |
| 2011/0285474 | A1 | 11/2011 | Ali | |
| 2012/0075155 | A1* | 3/2012 | Lindmark | H01Q 1/246 343/797 |
| 2012/0098725 | A1 | 4/2012 | Lytle et al. | |
| 2012/0280882 | A1* | 11/2012 | Zimmerman | H01Q 1/42 343/836 |
| 2015/0042531 | A1 | 2/2015 | Kitano et al. | |
| 2017/0358865 | A1 | 12/2017 | Sledkov et al. | |

FOREIGN PATENT DOCUMENTS

| | | | |
|---|---|---|---|
| CN | 102013551 | A | 4/2011 |
| CN | 103066381 | A | 4/2013 |
| CN | 103682597 | A | 3/2014 |
| CN | 203950930 | U | 11/2014 |
| CN | 104466426 | A | 3/2015 |
| JP | 05032984 | A | 2/1993 |
| JP | 2015033116 | A | 2/2015 |

* cited by examiner

ANTENNA SYSTEM

CROSS-REFERENCE TO RELATED APPLICATIONS

This application is a continuation of International Application No. PCT/CN2015/093455, filed on Oct. 30, 2015, the disclosure of which is hereby incorporated by reference in its entirety.

TECHNICAL FIELD

Embodiments of the present invention relate to the field of communications technologies, and in particular, to an antenna system.

BACKGROUND

Currently, a radome in a conventional base station antenna design system mainly includes three parts: a radiation array unit, a reflection panel used to define a direction, and a feeding system that is mounted on the reflection panel and provides an amplitude and a phase for the radiation array unit. The reflection panel is generally used as a carrier platform, and both the radiation array unit and the feeding network are connected to and mounted on the reflection panel.

For an antenna applied to a higher-order Multi Input Multi Output technical scenario, the conventional antenna structure form has a relatively complex structure design and requires more assembly hours, and an error is easily caused because many assembly components exist; therefore, consistency is also affected.

An existing design scheme provides a feeding system that includes an air microstrip, and in the feeding system, a reflection panel is used as a ground plane, which simplifies design to some extent. However, the air microstrip in this design scheme has obvious defects, that is, backward radiation is large, a voltage standing wave ratio is not stable, and being greater than a frequency band of 2 GHz; higher requirements are imposed on production and assembly, and therefore, the air microstrip is difficult to use.

SUMMARY

This application provides an antenna system, to simplify assembly of the antenna system and improve stability and consistency of the antenna system.

According to a first aspect, an antenna system is provided, and the antenna system includes:

a radiating element, a strip line that has a hollow cavity, and an inner conductor disposed in the hollow cavity, where the radiating element includes: at least two radiation baluns, radiation arms that are in one-to-one correspondence with and are connected to the radiation baluns, and feeding inner cores that are in one-to-one correspondence with the radiation arms; and an upper wall of the strip line is a strip line ground plane, and the radiation baluns are fastened on the strip line ground plane and are electrically connected to the strip line ground plane; and radiation arms that are in a same polarization direction in the radiating element are corresponding to one inner conductor, and the radiation arms that are in the same polarization direction are electrically connected to the inner conductor by using the corresponding feeding inner cores.

With reference to the foregoing first aspect, in a first possible implementation manner, a dielectric combination that can slide against the inner conductor is disposed on the inner conductor, and when the dielectric combination slides against the inner conductor, a transmission phase of the inner conductor can be changed, so that an offset of a maximum direction of a radiation pattern of the antenna system is caused, so as to better serve mobile communications.

With reference to the foregoing first aspect or the first possible implementation manner of the first aspect, in a second possible implementation manner, the hollow cavity is a hollow cavity structure with openings at two ends.

With reference to the foregoing first aspect or the first possible implementation manner of the first aspect, in a third possible implementation manner, the strip line ground plane is a strip line ground plane made by metallic materials that reflect radiation waves, and no independent reflective surface needs to be disposed because the strip line ground plane can be used as a reflective surface of the radiating element; therefore, a structure of the antenna system is simplified.

With reference to the foregoing third possible implementation manner of the first aspect, in a fourth possible implementation manner, a surface, of the strip line ground plane, that faces the radiating element is a flat surface or a convex arc surface.

With reference to the foregoing third possible implementation manner of the first aspect, in a fifth possible implementation manner, the radiation baluns have cavities, and the feeding inner cores are disposed in the cavities of the radiation baluns.

With reference to the foregoing first aspect, the first possible implementation manner of the first aspect, the second possible implementation manner of the first aspect, the third possible implementation manner of the first aspect, the fourth possible implementation manner of the first aspect, or the fifth possible implementation manner of the first aspect, in a sixth possible implementation manner, the feeding inner cores are connected to the inner conductor by means of welding, or the feeding inner cores are fixedly connected to the inner conductor by using a first connecting piece.

With reference to the foregoing sixth possible implementation manner of the first aspect, in a seventh possible implementation manner, the radiation baluns are fixedly connected to the strip line ground plane by using a second connecting piece.

With reference to the foregoing seventh possible implementation manner of the first aspect, in an eighth possible implementation manner, both the first connecting piece and the second connecting piece are bolts or screws.

With reference to the foregoing first aspect, the first possible implementation manner of the first aspect, the second possible implementation manner of the first aspect, the third possible implementation manner of the first aspect, the fourth possible implementation manner of the first aspect, the fifth possible implementation manner of the first aspect, the sixth possible implementation manner of the first aspect, the seventh possible implementation manner of the first aspect, or the eighth possible implementation manner of the first aspect, in a ninth possible implementation manner, the dual-polarization radiating element includes a radiation arm whose polarization direction is positive 45 degrees and a radiation arm whose polarization direction is negative 45 degrees; there are two inner conductors, the radiation arm whose polarization direction is positive 45 degrees is electrically connected to one inner conductor by using a corresponding connected feeding inner core, and the radiation arm whose polarization direction is negative 45 degrees is electrically connected to the other inner conductor by using a corresponding connected feeding inner core.

With reference to the foregoing ninth possible implementation manner of the first aspect, in an tenth possible implementation manner, a separator is disposed in the hollow cavity, the separator divides the hollow cavity into two side-by-side cavities, and the two inner conductors are located in the two cavities respectively.

With reference to the foregoing first aspect, the first possible implementation manner of the first aspect, the second possible implementation manner of the first aspect, the third possible implementation manner of the first aspect, the fourth possible implementation manner of the first aspect, the fifth possible implementation manner of the first aspect, the sixth possible implementation manner of the first aspect, the seventh possible implementation manner of the first aspect, the eighth possible implementation manner of the first aspect, the ninth possible implementation manner of the first aspect, or the tenth possible implementation manner of the first aspect, in an eleventh possible implementation manner, the radiating element is arranged in at least two rows, and each row of radiating elements is corresponding to one strip line.

With reference to the foregoing eleventh possible implementation manner of the first aspect, in a twelfth possible implementation manner, multiple strip lines are of an integrated structure.

With reference to the foregoing first aspect, the first possible implementation manner of the first aspect, the second possible implementation manner of the first aspect, the third possible implementation manner of the first aspect, the fourth possible implementation manner of the first aspect, the fifth possible implementation manner of the first aspect, the sixth possible implementation manner of the first aspect, the seventh possible implementation manner of the first aspect, the eighth possible implementation manner of the first aspect, the ninth possible implementation manner of the first aspect, the tenth possible implementation manner of the first aspect, the eleventh possible implementation manner of the first aspect, or the twelfth possible implementation manner of the first aspect, in a thirteenth possible implementation manner, the antenna system further includes a radome, where the radome covers the strip line and the radiating element.

A strip line ground plane is used as a reflective surface of a radiating element, and therefore, no independent reflective surface needs to be disposed, so that a structure of an antenna system is simplified. In addition, radiation baluns are electrically connected to the strip line ground plane, and all of feeding inner cores of radiation arms that are in a same polarization direction in the radiating element are electrically connected to one inner conductor, that is, a strip line of a strip line feeding system feeds the radiation arms in the same polarization direction one by one. Therefore, a feeding manner of an array antenna can be optimized very conveniently, assembly time is greatly reduced, quantities of welding points and cables are reduced, and because of reduced quantities of welding points and cables, consistency and reliability of the antenna system are improved.

Figure 1:
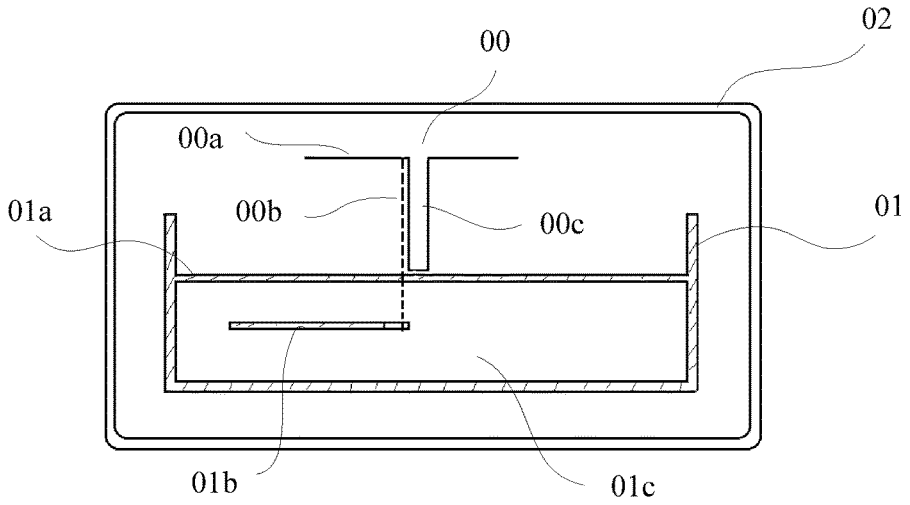
FIG. 1 is a schematic diagram of a side cross section of a connection between a radiating element and a strip line in an antenna system according to an embodiment of the present invention.

Reference signs in the drawings:

00—radiating element, 00*a*—radiation arm, 00*a*1—first polarized radiation arm

00*a*2—second polarized radiation arm, 00*b*—feeding inner core, 00*b*1—first feeding inner core

00*b*2—second feeding inner core, 00*c*—radiation balun, 01—strip line, 01*a*—strip line ground plane

01*a*1—first strip line ground plane, 01*a*2—second strip line ground plane, 01*b*—inner conductor

01*b*1—first inner conductor, 01*b*2—second inner conductor, 01*c*—hollow cavity

01*c*1—first hollow cavity, 01*c*2—second hollow cavity, 21—strip line

201, 202, 203, . . . , 20*n*—radiating elements, 201*a*1—first polarized radiation arm

201*a*2—second polarized radiation arm, 201*b*1—first feeding inner core

201*b*2—second feeding inner core, 201*d*1 and 201*d*2—electrical connection points

201*e*—electrical connection point, 21*b*1—first inner conductor, 21*b*2—second inner conductor

21*c*1—first hollow cavity, 21*c*2—second hollow cavity, 02—radome

DESCRIPTION OF EMBODIMENTS

The following describes specific embodiments of the present invention in detail with reference to accompanying drawings. It should be understood that the specific implementation manners described herein are merely used to describe and explain the present invention but are not intended to limit the present invention.

Figure 2:
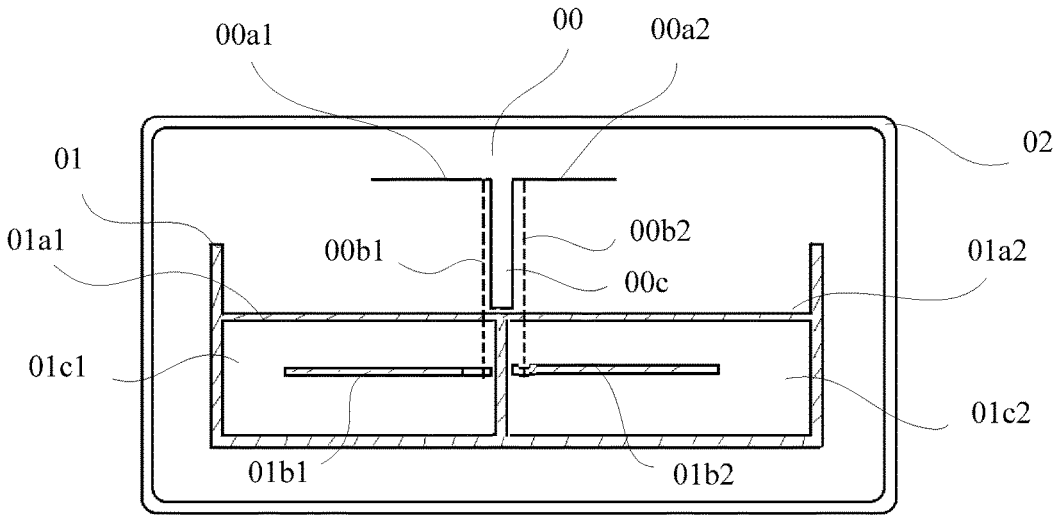
FIG. 2 is a schematic diagram of a side cross section of a connection between a radiating element and a strip line in an antenna system according to another embodiment of the present invention.
Figure 4:
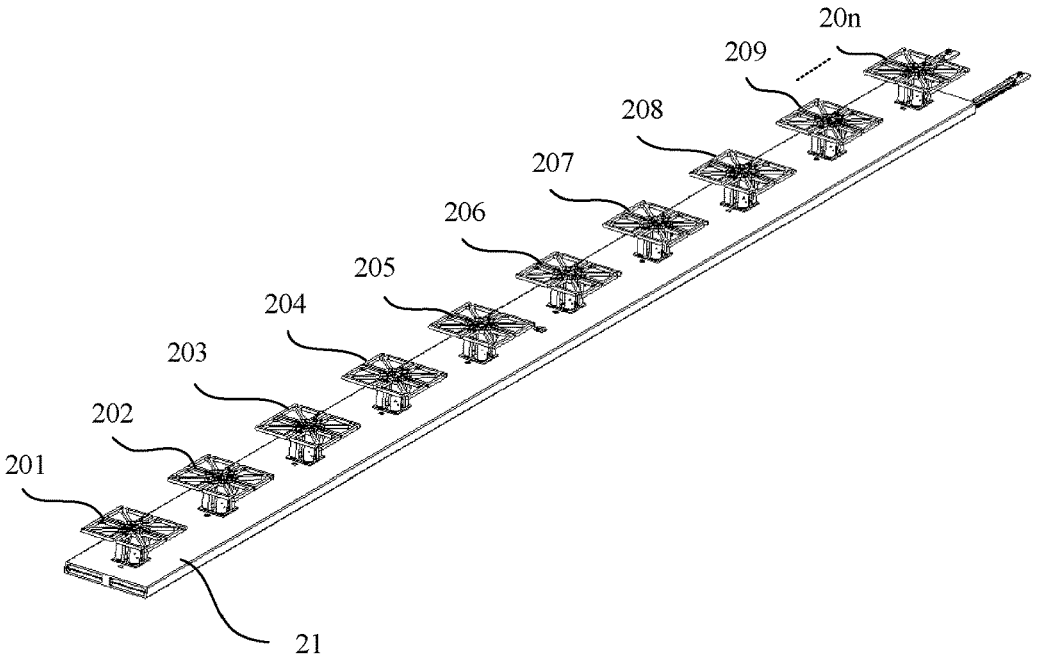
FIG. 4 is a schematic structural diagram of an antenna system according to an embodiment of the present invention.

As shown in FIG. 1, FIG. 2, and FIG. 4, FIG. 1 is a schematic diagram of a side cross section of a connection between a radiating element and a strip line in an antenna system according to an embodiment of the present invention, FIG. 2 is a schematic diagram of a side cross section of a connection between a radiating element and a strip line in an antenna system according to another embodiment of the present invention, and FIG. 4 is a schematic structural diagram of an antenna system according to an embodiment of the present invention.

An embodiment of the present invention provides an antenna system, and the antenna system includes:

a radiating element 00, a strip line 01 that has a hollow cavity 01*c*, and an inner conductor 01*b* disposed in the hollow cavity 01*c*, where the radiating element 00 includes: at least two radiation baluns 00*c*, radiation arms 00*a* that are in one-to-one correspondence with and are connected to the radiation baluns 00*c*, and feeding inner cores 00*b* that are in one-to-one correspondence with the radiation arms 00*a*; and an upper wall of the strip line (01) is a strip line ground plane (01*a*), and the radiation baluns (00*c*) are fastened on the strip line ground plane 01*a* and are electrically connected to the strip line ground plane 01*a*; and radiation arms 00*a* that are in a same polarization direction in the radiating element 00 are corresponding to one inner conductor 01*b*, and the radiation arms 00*a* that are in the same polarization direction are electrically connected to the inner conductor 01*b* by using the corresponding feeding inner cores 00*b*.

In the foregoing embodiment, a strip line ground plane 01*a* is used as a reflective surface of a radiating element 00, and therefore, no independent reflective surface needs to be disposed, so that a structure of an antenna system is simplified. In addition, radiation baluns 00*c* are electrically connected to the strip line ground plane 01*a*, and all of feeding inner cores 00*b* of radiation arms 00*a* that are in a same polarization direction in the radiating element 00 are electrically connected to one inner conductor 01*b*, that is, a strip line 01 of a strip line feeding system feeds the radiation arms 00*a* in the same polarization direction one by one. Therefore, a feeding manner of an existing array antenna can be optimized very conveniently, and assembly time is greatly reduced. In a prior-art structure, feeding inner cores of each radiating element are corresponding to one inner conductor. By comparison, quantities of welding points and cables used to connect inner conductors are reduced, and therefore, consistency and reliability are improved.

To facilitate understanding of the embodiments of the present invention, the following describes in detail a structure of the antenna system with reference to specific embodiments.

As shown in FIG. 1 and FIG. 2, the antenna system provided in the embodiments may include a radome 02, where the radome 02 covers the strip line 01 and the radiating element 00.

The radiating element in the antenna system provided in the embodiments may be a single-polarization radiating element or a dual-polarization radiating element, and the following describes the radiating element in detail with reference to specific embodiments.

Embodiment 1

As shown in FIG. 1. FIG. 1 is a schematic diagram of a side cross section of a connection between a radiating element and a strip line, and in this embodiment, the radiating element is a single-polarization radiating element.

Specifically, as shown in FIG. 1, a radiating element 00 includes radiation arms 00*a* in a same polarization direction, the radiation arm 00*a* is fastened on the top of a radiation balun 00*c*, and the radiation arm 00*a* is corresponding to a feeding inner core 00*b* that electrically feeds the radiation arm 00*a*, where the radiation arm 00*a* may be connected, in an electrical coupling manner or a welding manner, to the feeding inner core 00*b* corresponding to the radiation arm 00*a* for feeding. A strip line 01 has a hollow cavity 01*c* that is corresponding to the foregoing radiation arms 00*a*, and the strip line 01 has a strip line ground plane 01*a* that is corresponding to the radiation arms 00*a* in the same polarization direction. As shown in FIG. 1, the strip line ground plane 01*a* is an upper sidewall of the hollow cavity 01*c*. An inner conductor 01*b* is disposed in the hollow cavity 01*c*, and the inner conductor 01*b* is suspendedly disposed in the hollow cavity. In a specific connection, radiation baluns 00*c* of the radiating element 00 are electrically connected to the strip line ground plane 01*a*, and feeding inner cores 00*b* are electrically connected to the inner conductor 01*b*.

A surface, of the strip line ground plane 01*a*, that faces the radiating element 00 is used as a reflective surface, and is used to reflect a radiation wave transmitted by the radiating element 00. Therefore, a structure of an antenna system is simplified, and no reflective structure that is used to reflect a radiation wave needs to be disposed independently. In specific disposing, the surface, of the strip line ground plane 01*a*, that faces the radiating element 00 is a flat surface or a convex arc surface, and the strip line ground plane 01*a* is made by metallic materials.

In addition, the inner conductor 01*b* provided in this embodiment is of a PCB structure or a metal strip line structure. In this embodiment, as another optional solution, a dielectric combination that can slide against the inner conductor 01*b* is disposed on the inner conductor 01*b*. When the dielectric combination slides against the inner conductor 01*b*, a transmission phase of the inner conductor 01*b* may be changed, so that an offset of a maximum direction of a radiation pattern of the antenna system is caused, so as to better serve mobile communications.

In addition, the hollow cavity 01*c* of the strip line 01 provided in this embodiment is a hollow cavity 01*c* with openings at two ends. When the inner conductor 01*b* is being disposed, the inner conductor 01*b* may directly penetrate into the hollow cavity 01*c* through an opening of the hollow cavity 01*c*, thereby facilitating disposing of the inner conductor 01*b* and improving entire antenna production efficiency.

For the antenna system provided in this embodiment, the radiating element 00 and the strip line 01 are covered by a protective cover, and in specific disposing, the protective cover covers the radiating element 00 and the strip line 01.

In specific disposing, there may be multiple radiating elements 00, each radiation balun 00*c* is electrically connected to the strip line ground plane 01*a*, and each feeding inner core 00*b* is electrically connected to the inner conductor 01*b*. Specifically, the multiple radiating elements 00 are arranged in a single row, and an orientation of the radiating elements 00 that are arranged in a single row is the same as a length direction of the hollow cavity 01*c*, that is, the multiple radiating elements 00 are arranged along the length direction of the hollow cavity 01*c* to form a row of radiating elements.

Embodiment 2

Figure 3:
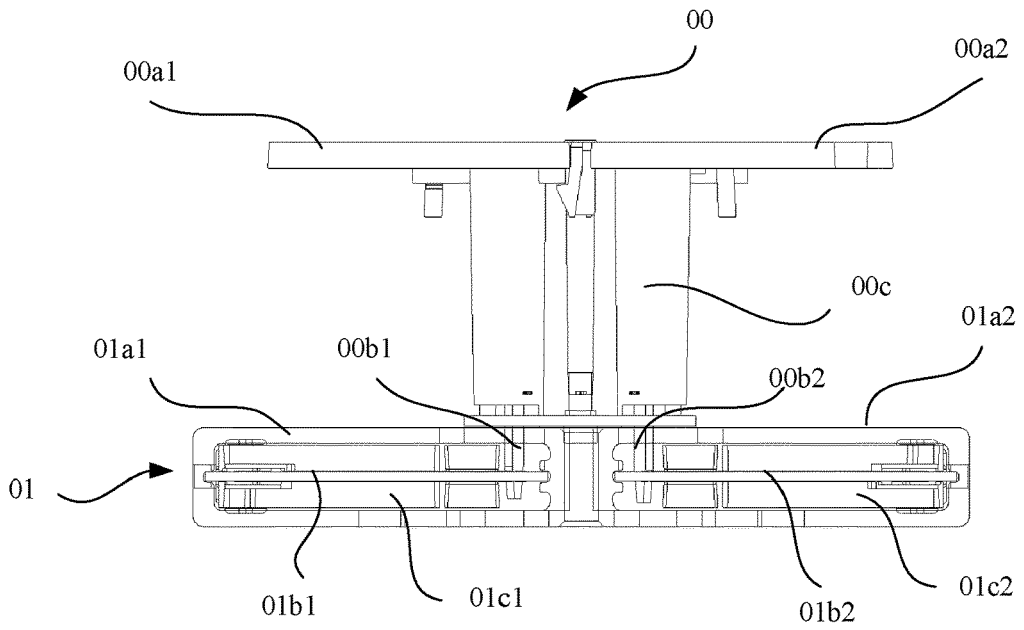
FIG. 3 is a cross-sectional view of a side structure of a connection between a radiating element and a strip line in an antenna system according to another embodiment of the present invention.

As shown in FIG. 2 and FIG. 3, an antenna in an antenna system provided in this embodiment is a dual-polarization antenna, that is, a radiating element 00 has radiation arms in two polarization directions, where FIG. 2 is a schematic diagram of a side cross section of the dual-polarization antenna, and FIG. 3 is a cross-sectional view of a side structure of the dual-polarization antenna.

In this embodiment, the radiating element 00 is a dual-polarization radiating element, and the dual-polarization radiating element includes a radiation arm whose polarization direction is positive 45 degrees and a radiation arm whose polarization direction is negative 45 degrees. Two inner conductors are disposed in a hollow cavity, the radiation arm whose polarization direction is positive 45 degrees is electrically connected to one inner conductor by using a feeding inner core to which the radiation arm whose polarization direction is positive 45 degrees is connected, and the radiation arm whose polarization direction is negative 45 degrees is electrically connected to the other inner conductor by using a feeding inner core to which the radiation arm whose polarization direction is negative 45 degrees is connected.

In a specific connection, the radiation arm whose polarization direction is positive 45 degrees is a first polarized radiation arm 00*a*1, and the radiation arm whose polarization direction is negative 45 degrees is a second polarized radiation arm 00*a*2, where the first polarized radiation arm 00*a*1 is corresponding to a first feeding inner core 00*b*1, and the second polarized radiation arm 00*a*2 is corresponding to a second feeding inner core 00*b*2. The foregoing radiation arms may be connected, in an electrical coupling manner or a welding manner, to the feeding inner cores corresponding to the radiation arms for feeding. The foregoing radiation balun 00*c* has a cavity, and the feeding inner cores 00*b*1 and 00*b*2 are disposed in the cavity of the radiation balun 00*c*. A separator is disposed in the hollow cavity of a strip line 01, the separator divides the hollow cavity into two side-by-side cavities, and the two inner conductors are located in the two cavities respectively. The foregoing two cavities are respectively a first hollow cavity 01*c*1 and a second hollow cavity 01*c*2. An upper sidewall of the first hollow cavity Old is a first strip line ground plane 01*a*1, and a first inner conductor 01*b*1 is disposed in the first hollow cavity 01*c*1. An upper sidewall of the second hollow cavity 01*c*2 is a second strip line ground plane 01*a*2, and a second inner conductor 01*b*2 is disposed in the second hollow cavity 01*c*2. For a specific connection manner, reference may be made to a connection manner of the radiating element 00 and the strip line 01 in Embodiment 1, that is, the first polarized radiation arm 00*a*1 is fastened on a radiation balun 00*c*, the radiation balun 00*c* is electrically connected to the first strip line ground plane 01*a*1, and the first feeding inner core 00*b*1 is electrically connected to the first inner conductor 01*b*1; the second polarized radiation arm 00*a*2 is fastened on a radiation balun 00*c*, the radiation balun 00*c* is electrically connected to the second strip line ground plane 01*a*2, and the second feeding inner core 00*b*2 is connected to the second inner conductor 01*b*2. In addition, in specific disposing, the first strip line ground plane 01*a*1 and the second strip line ground plane 01*a*2 may be of an integrated structure.

In this embodiment, the two hollow cavities divided by the separator are arranged side by side. For each hollow cavity, structures of the hollow cavity, an inner conductor 01*b*, and a strip line ground plane 01*a* are similar to structures in the foregoing Embodiment 1, and details are not described herein. In addition, when the first strip line ground plane 01*a*1 and the second strip line ground plane 01*a*2 are of an integrated structure, a surface, of the strip line ground plane 01*a* in the integrated structure, that faces the radiating element 00 is used as a reflective surface, and a shape of the surface is an arc or a planform.

To facilitate understanding of the antenna system provided in this embodiment, the following describes in detail the antenna system with reference to accompany drawings.

As shown in FIG. 4, FIG. 4 shows a structure of a dual-polarization antenna system according to an embodiment. In FIG. 4, radiating elements in the antenna system are arranged in a single row, and the radiating elements are arranged along a length direction of a hollow cavity. The radiating elements included in the antenna system are 201, 202, 203, 204, 205, 206, 207, 208, 209, . . . , 20*n*.

Figure 5:
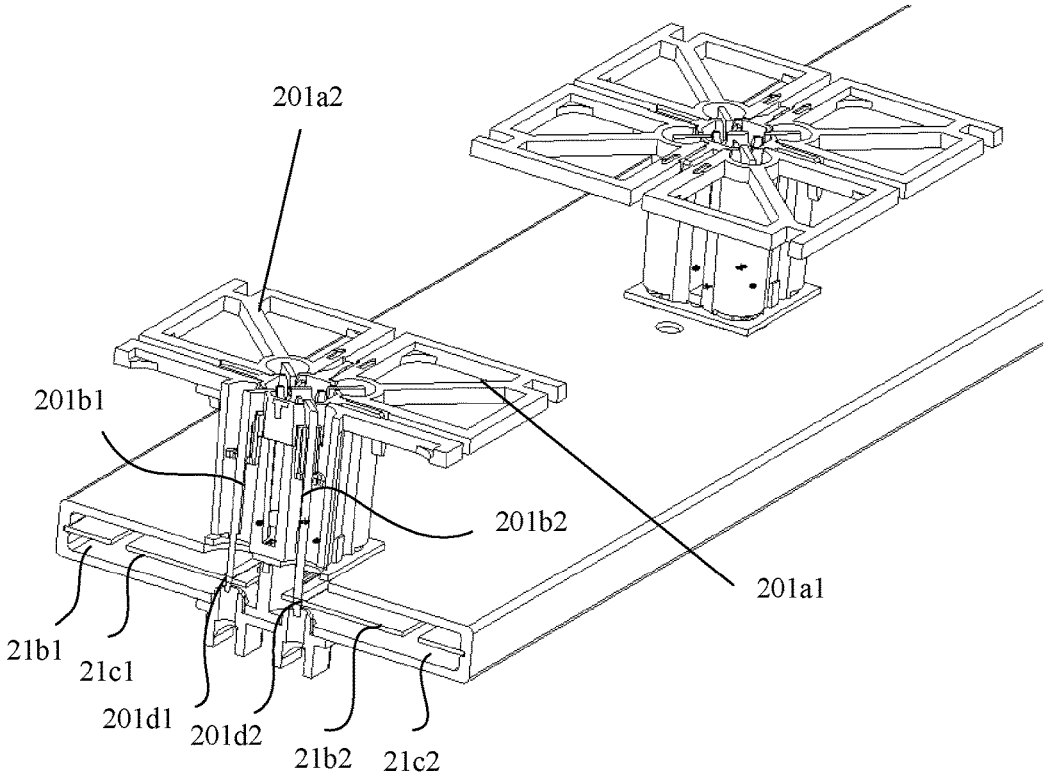
FIG. 5 is a schematic diagram of a connection between an inner conductor of a microstrip and a feeding inner core in an antenna system according to an embodiment of the present invention.
Figure 6:
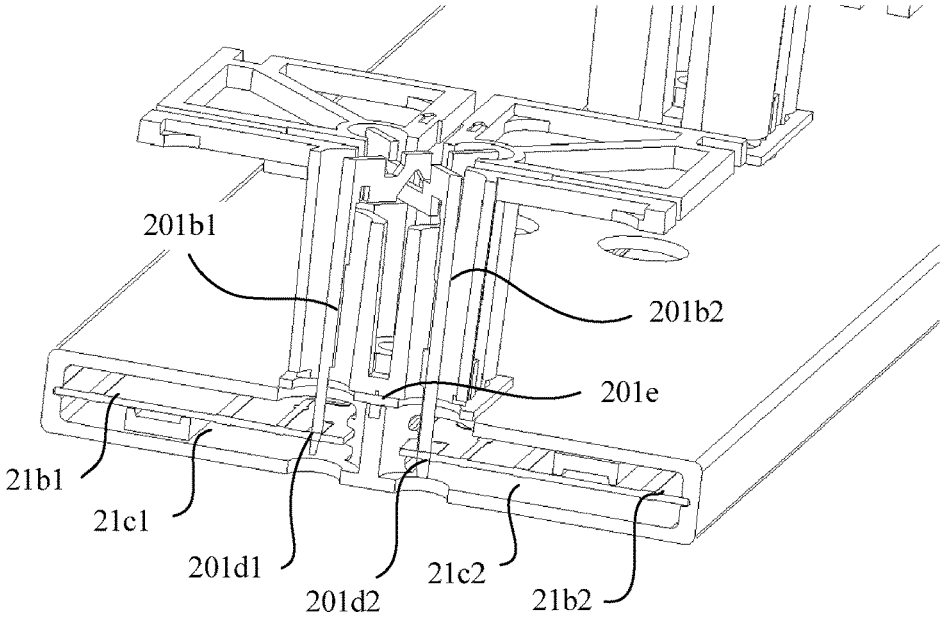
FIG. 6 is a schematic diagram of a connection between a radiation balun and a strip line ground plane in an antenna system according to an embodiment of the present invention.

The radiating element 201 is used as an example; as shown in FIG. 5, the radiating element 201 includes a first polarized radiation arm 201*a*1 and a second polarized radiation arm 201*a*2. A first feeding inner core 201*b*1 of the radiating element 201 is connected to a first inner conductor 21*b*1 in a first hollow cavity 21*c*1 of a strip line 21, and an electrical connection point 201*d*1 between the first feeding inner core 201*b*1 and the first inner conductor 21*b*1 is shown in FIG. 5. A second feeding inner core 201*b*2 of the radiating element 201 is connected to a second inner conductor 21*b*2 in a second hollow cavity 21*c*2 of the strip line 21, and an electrical connection point 201*d*2 between the second feeding inner core 201*b*2 and the second inner conductor 21*b*2 is shown in FIG. 5. In the foregoing specific connection, the feeding inner cores are connected to the inner conductors by means of welding, or the feeding inner cores are fixedly connected to the inner conductors by using a first connecting piece. Preferably, in this embodiment, a connection is established by using a connecting piece; during a specific connection, the connecting piece may be a bolt or a screw. An electrical connection point 201*e* between the radiation balun and the strip line ground plane is shown in FIG. 6. In this embodiment, the radiation balun is electrically connected to the strip line ground plane by using a second connecting piece, where the second connecting piece is a bolt or a screw. Electrical connection points that are not shown in FIG. 6 may further be 202*e*, . . . 20*ne*, which are respectively and correspondingly used to electrically connect radiation baluns of radiation arms 201 to 20*n* and the strip line ground plane, and structures and connection manners of the electrical connection points are the same as those of the electrical connection point 201*e* of the radiating element 201.

In this embodiment, a separator is used to isolate the hollow cavity into two independent strip line cavities, so as to ensure that isolation indicators of two polarizations in a mobile communications system are met.

The antenna system shown in FIG. 4 is an integrated array antenna system, includes a radiation array that includes n radiation arms whose polarization directions are positive or negative 45 degrees, and includes two electrically isolated strip lines, that is, two electrically isolated hollow cavities and inner conductors.

To better explain working principles, a signal in one strip line feeds radiation arms 201*a*1, 202*a*1, 203*a*1, . . . , 20*na*1 of radiating elements by using an inner conductor, and the radiation arms 201*a*1, 202*a*1, 203*a*1, . . . , 20*na*1 of the radiating elements together form a radiator, of the array antenna, whose polarization direction is positive 45 degrees.

A signal in the other strip line feeds radiation arms 201*a*2, 202*a*2, 203*a*2, . . . , 20*na*2 of the radiating elements by using an inner conductor, and the radiation arms 201*a*2, 202*a*2, 203*a*2, . . . , 20*na*2 of the radiating elements together form a radiator, of the array antenna, whose polarization direction is negative 45 degrees.

Figure 7:
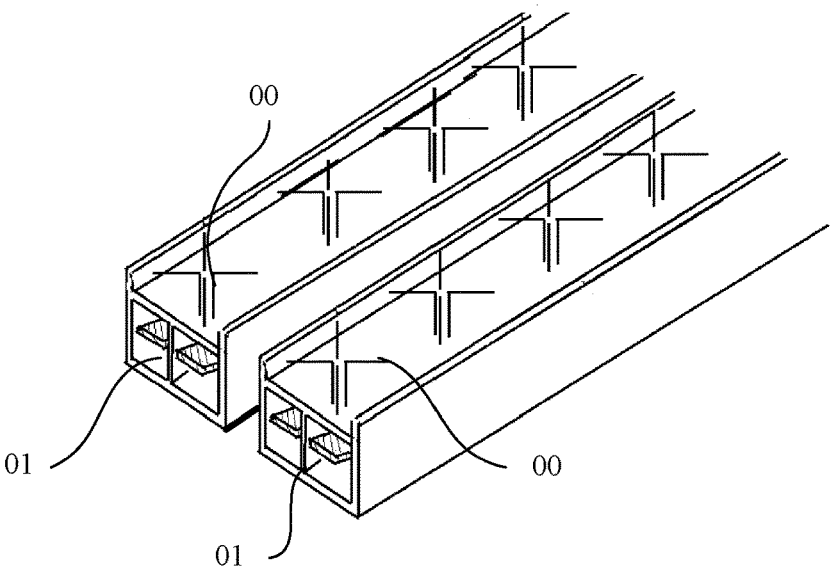
FIG. 7 is a schematic structural diagram of an antenna according to an embodiment of the present invention.
Figure 8:
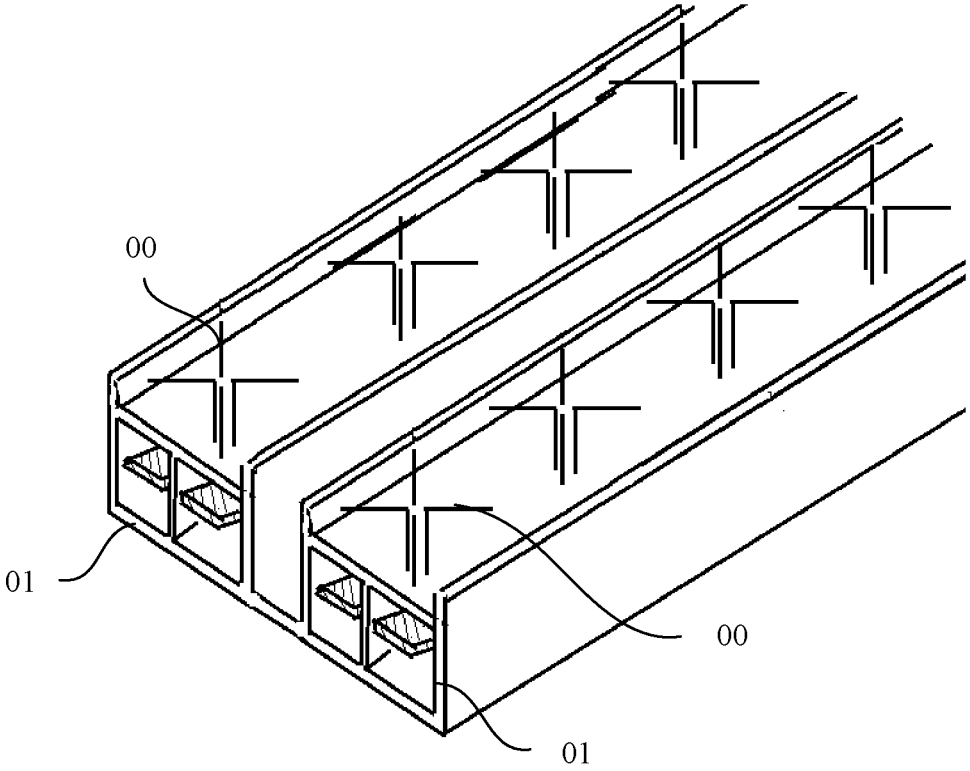
FIG. 8 is a schematic structural diagram of a planar antenna according to another embodiment of the present invention.

In specific disposing, there are multiple radiating elements, each radiation balun is electrically connected to a strip line ground plane, and each feeding inner core is electrically connected to an inner conductor. Specifically, the multiple radiating elements may be arranged in a single row, or arranged in an array manner, and an orientation of the single row of radiating elements is the same as a length direction of a hollow cavity. When strip lines are arranged in multiple columns, an antenna system is formed. Refer to FIG. 7 and FIG. 8 together, multiple strip lines may use independent structures, or use an integrated structure. As shown in FIG. 7, strip lines in FIG. 7 use independent structures, that is, strip lines of all columns of radiating elements are independent of each other. As shown in FIG. 8, strip lines corresponding to multiple columns of radiating elements in FIG. 8 are of an integrated structure, that is, strip lines corresponding to all columns of radiating elements are integrally connected.

The antenna system provided in all the embodiments of this application may be connected to a base station, and the base station receives information from a user or transmits information to a user by using the antenna system. The antenna system connects to and communicates with the base station by using a remote radio unit, and the base station may be a base transceiver station ("BTS" for short) in a Global System for Mobile Communications ("GSM" for short) or Code Division Multiple Access ("CDMA" for short) system, or may be a NodeB ("NB" for short) in Wideband Code Division Multiple Access ("WCDMA" for short), or may be an evolved NodeB ("ENB" or "eNodeB" for short) in LTE; the base station may be a macro base station, or may be a small cell, which is not limited in the present invention. Obviously, a person skilled in the art can make various modifications and variations to the present invention without departing from the spirit and scope of the present invention. The present invention is intended to cover these modifications and variations provided that they fall within the scope of protection defined by the following claims and their equivalent technologies.

What is claimed is:

1. An antenna system, comprising:

a radiating element, a strip line that has a hollow cavity, and an inner conductor disposed in the hollow cavity, wherein:

the radiating element comprises: at least two radiation baluns, radiation arms that are in one-to-one correspondence with and are connected to the radiation baluns, and feeding inner cores that are in one-to-one correspondence with the radiation arms;

an upper wall of the strip line is a strip line ground plane, and the radiation baluns are fastened on the strip line ground plane and are electrically connected to the strip line ground plane;

radiation arms that are in a same polarization direction in the radiating element are corresponding to one inner conductor, and the radiation arms that are in the same polarization direction are electrically connected to the inner conductor by using corresponding feeding inner cores;

the radiating element is a dual-polarization radiating element, and the dual-polarization radiating element comprises a radiation arm whose polarization direction is positive 45 degrees and a radiation arm whose polarization direction is negative 45 degrees; and there are two inner conductors, the radiation arm whose polarization direction is positive 45 degrees is electrically connected to one inner conductor by using a corresponding connected feeding inner core, and the radiation arm whose polarization direction is negative 45 degrees is electrically connected to the other inner conductor by using a corresponding connected feeding inner core.

2. The antenna system according to claim 1, wherein a dielectric combination that can slide against the inner conductor is disposed on the inner conductor.

3. The antenna system according to claim 1, wherein the hollow cavity is a hollow cavity structure with openings at two ends.

4. The antenna system according to claim 1, wherein the strip line ground plane is a strip line ground plane made by metallic materials that reflect radiation waves.

5. The antenna system according to claim 4, wherein a surface of the strip line ground plane that faces the radiating element is a flat surface or a convex arc surface.

6. The antenna system according to claim 4, wherein the radiation baluns have cavities, and the feeding inner cores are disposed in the cavities of the radiation baluns.

7. The antenna system according to claim 1, wherein the feeding inner cores are connected to the inner conductor by means of welding, or the feeding inner cores are fixedly connected to the inner conductor by using a first connecting piece.

8. The antenna system according to claim 7, wherein the radiation baluns are fixedly connected to the strip line ground plane by using a second connecting piece.

9. The antenna system according to claim 8, wherein both the first connecting piece and the second connecting piece are bolts or screws.

10. The antenna system according to claim 1, wherein a separator is disposed in the hollow cavity, the separator divides the hollow cavity into two side-by-side cavities, and the two inner conductors are located in the two cavities respectively.

11. The antenna system according to claim 1, wherein multiple radiating elements are arranged in at least one row, and each row of radiating elements is corresponding to one strip line.

12. The antenna system according to claim 11, wherein multiple strip lines are of an integrated structure.

13. The antenna system according to claim 1, further comprising: a radome, wherein the radome covers the strip line and the radiating element.

* * * * *